US005375718A

United States Patent [19]

Honma et al.

[11] Patent Number: 5,375,718

[45] Date of Patent: Dec. 27, 1994

[54] PACKAGE WITH PACKAGING FILM WITH DETACHABLE TAB AND METHOD FOR WRAPPING THE ARTICLE BY THE PACKAGING FILM

[75] Inventors: Hiroyuki Honma; Masaei Fukaya; Takatsugu Funawatari, all of Miyagi, Japan

[73] Assignee: Sony Corporation, Japan

[21] Appl. No.: 138,268

[22] Filed: Oct. 20, 1993

[30] Foreign Application Priority Data

Oct. 30, 1992 [JP] Japan ..... 4-315732

[51] Int. Cl.[5] ..... B65D 65/32

[52] U.S. Cl. ..... 206/497; 53/442; 229/924; 229/926

[58] Field of Search ..... 229/924, 926; 206/497; 53/442

[56] References Cited

U.S. PATENT DOCUMENTS 3,201,258 8/1965 Mastella .
4,782,956 11/1988 Yoshizawa ..... 229/926 X

FOREIGN PATENT DOCUMENTS 1874998 7/1963 Germany .
4020945 1/1992 Germany .
9306023 4/1993 WIPO ..... 229/926

*Primary Examiner*—William I. Price
*Attorney, Agent, or Firm*—Ronald P. Kananen

[57] ABSTRACT

A package consisting in an article packaged by a packaging film exhibiting heat shrinkability is disclosed. The packaging film has its wrapping terminal end formed with a protuberant tearing tab, and a severing tape is bonded to the inner surface of the film for extending from the distal end of the tearing tab along the entire length of the film along the article wrapping direction. The severing tape has a width lesser than the width of the tearing tab and is formed of a material having heat shrinkage percentage lower than that of the film. The tearing tab has its distal end reduced in width for reducing the allowance for heat fusion. For reducing the allowance for heat fusion, the distal end of the tearing tab is semi-circular in contour. The distal end of the severing tape substantially in register with the center sealing region of the film is designed as a non-fusing region to facilitate the exfoliation of the severing tape.

11 Claims, 4 Drawing Sheets

PACKAGE WITH PACKAGING FILM WITH DETACHABLE TAB AND METHOD FOR WRAPPING THE ARTICLE BY THE PACKAGING FILM

BACKGROUND OF THE INVENTION

1. Field of the Invention

This invention relates to a package, that is a packaged article, obtained by wrapping an article with a packaging film, and a method for wrapping an article with the packaging film. More particularly, it relates to a packaged article obtained by wrapping a film around the entire periphery of an article and heat-shrinking the film in its entirety for wrapping the article in a hermetically sealed condition, and a method for wrapping the article using such heat-shrinkable film.

2. Description of the Related Art

There has hitherto been known a method for wrapping an article 2 under an hermetically sealed condition by a heat-shrinkable packaging film 1, as shown in FIGS. 1 and 2. As the film 1, a transparent bi-axially stretched polypropylene film (OPP), having a thickness on the order of 25 to 30 μm, is generally employed. A severing tape 3 is connected to the inner surface of the film 1 for tearing the film 1 for taking out the packaged article 2.

That is, the packaging film 1 is cut to an outer size slightly larger than the developed size of the article 2 and wrapped around the entire periphery of the article 2 so that both longitudinal ends 4, 5 of the film are overlapped with each other, while outer transverse lateral sides of the film 2 are also folded on the outer lateral sides of the article 2. The ends 4 and 5 of the film 1 are heat-welded to each other, and the film 1 is heat-shrunk by being heated in its entirety by a heat-shrinking unit, not shown, so as to be intimately applied to the article to complete a packaged article 6.

The longitudinal end 5 of the packaging film 1 along the article wrapping direction is formed with a strip-shaped tearing tab 7 and the above-mentioned severing tape 3 is connected to the foremost part of the tearing tab 7 for extending therefrom along the entire length in the article wrapping direction. The proximal end of the tab 7 is formed with a pair of slits 8, 8 for extending towards the main body of the film 1. The distance between the slits 8, 8 along the short sides of the package 2 is selected to be slightly larger than the width of the severing tape 3. The difference in the dimension between the tearing tab 7 and the severing tape 3 along the shorter sides of the package 2 is set so that the severing tape 3 is not positioned off the tearing tab 7 even if a wrapping deviation is produced along the short sides of the package 2 when wrapping the film on the article 2.

With the packaged article 6 obtained by wrapping the packaging film 1 around the article 2 under a hermetically sealed condition, the severing tape 3 may be exfoliated from the packaging film 1 along with the tearing tab 7 and pulled strongly along the wrapping direction for tearing off the film 1 for taking out the article 2. The slits 8, 8 formed in the proximal end of the tearing tab 7 functions as a guide in tearing off the packaging film 1 by the severing tape 3.

With the above-described conventional packaging film 1, there are formed regions A, A on both sides of the tearing tab 7 due to the difference in size from the severing tape 3 along the short sides of the package 2, as shown in FIG. 2, so that, when heat-welding the overlapped ends 4, 5 of the film 1, these regions A, A are heat-fused simultaneously.

Thus, with the above-described packaged article 6, it is extremely difficult to peel the tearing tab 7 having the heat-welded regions A, A off from the film 1, when tearing off the packaging film 1 by the severing tape 3, such that the tearing tab 7 frequently can be exfoliated only by scratching the tab with the finger nail. Besides, it occurs frequently that the severing tape 3 is severed halfway without allowing the film 1 to be torn off to take out the package 2.

OBJECTS AND SUMMARY OF THE INVENTION

It is a primary object of the present invention to provide a packaging film with a detachable tab and a method for wrapping the article by the packaging film which are free from the disadvantages inherent in the conventional package and packaging method.

It is another object of the present invention to provide a package consisting of an article and a wrapping film wrapped around the article under a hermetically sealed condition, and a method for packaging the article by a wrapping film under such condition, in which the tearing off of the tearing tab and the severing tape may be facilitated without detracting from the appearance and hermetic sealing properties.

It is yet another object of the present invention to provide the packaging method in which processing of the distal end of the severing tape according to the present invention may be performed within the wrapping process per se to prevent the number of processing steps from being increased.

The packaging film for providing the package according to the present invention has its wrapping terminal end formed with a protuberant tearing tab, when it is wrapped around an article, and a severing tape is bonded to the inner surface of the film for extending from the distal end of the tearing tab along the entire length of the film along the article wrapping direction. The severing tape has a width less than the width of the tearing tab and is formed of a material having heat shrinkage percentage lower than that of the film. The tearing tab has its distal end reduced in width for reducing the allowance for heat fusion.

The tearing tab of the packaging film has a semi-circular contour. At least the portion of the severing tape which, when the film is wrapped around the article, is substantially in register with the wrapping beginning end of a packaging film so as to be constituted as a heat fusing region, is formed as a non-bonded region.

The severing tape is bonded to the inner surface of the packaging film for extending throughout the entire length of the film along the article wrapping direction. A pair of slits are formed as tearing guides at a distance from each other larger than the width of the severing tape for defining a tab therebetween and the severing tape formed of a material having the heat shrinkage percentage lower than that of the packaging film has its distal end protruded and exposed from the wrapping terminal end.

The method for packaging an article according to the present invention makes use of a packaging film having its forward end along the article wrapping direction formed with a protuberant tearing tab having its distal end reduced in width for reducing the allowance for heat fusion, with a severing tape formed of a material having a reduced heat shrinkage percentage and having a width less than the tearing tab being bonded to the packaging film for extending from the distal end of the tearing tab throughout the entire length of the film along the article wrapping direction. The method comprises heat-fusing both ends of the packaging film which has enclosed and has been wrapped around the article and allowing the packaging film in its entirety to be heat-shrunk for exposing the distal end of the severing tape from the distal end of the tearing tab. The method also comprises packaging the article using the packaging film to the inner surface of which is bonded the severing tape having at least its portion substantially in register with the heat fusing region formed as a non-bonded or non-fusing region.

With the above-described package and the packaging method making use of the packaging film, according to the present invention, since the tearing tab has its heat-fusing allowance reduced by reducing the distal end of the tab in width, the tearing tab is not heat-fused, or heat-fused only with a lower fusing power, when heat-fusing both overlapped ends of the packaging film, due to the presence of the distal end of the severing tape exposed at the distal end of the tearing tab.

Besides, since the severing tape is formed of a material having a lesser heat shrinkage percentage than that of the packaging film, the tearing tab formed as one with the packaging film heat-shrunk by a heat shrinkage unit after wrapping and enclosing the article therein is shrunk to a larger extent beginning from its weakly bonded distal end as it pulls the distal end of the severing tape, so that the distal end of the severing tape is protruded and exposed from the distal end of the tearing tape while being curled upwards. Thus the packaging film may be torn off by simply pulling the expose distal end of the severing tape without the inconvenience of the tearing tab being scratched with the finger nail.

DETAILED DESCRIPTION OF THE PREFERRED EMBODIMENTS

Figure 1:
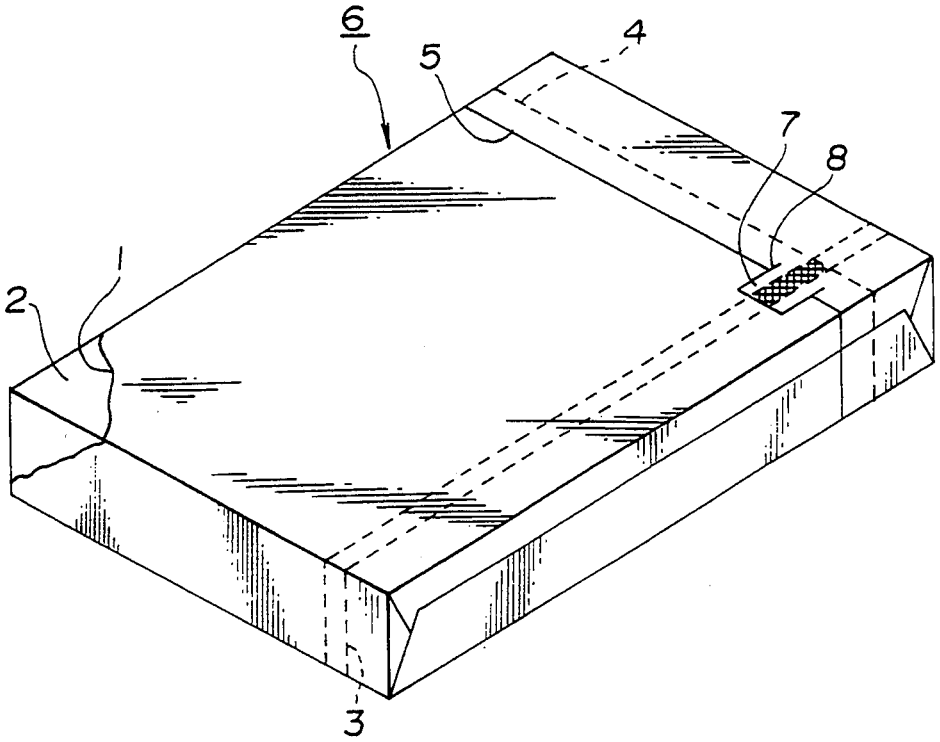
FIG. 1 is a perspective view showing a packaged article obtained by packaging an article with a conventional packaging film, with a portion of the film being broken away.

Referring to the drawings, preferred embodiments of the present invention will be explained in detail.

Figure 2:
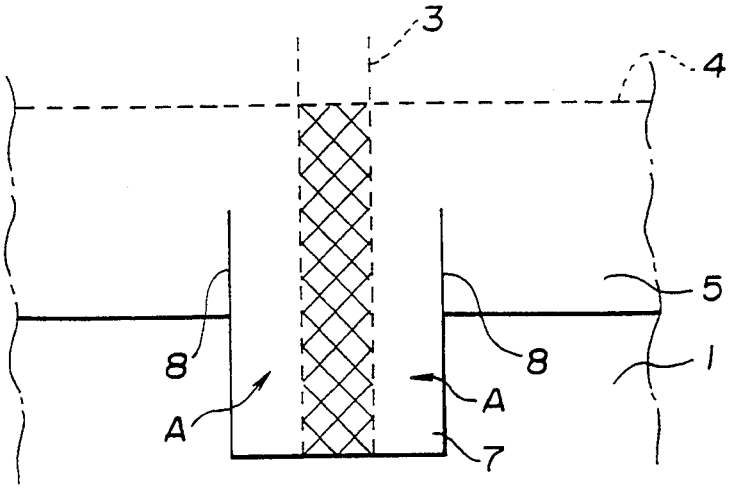
FIG. 2 is a plan view showing a center sealing portion of the packaging film shown in FIG. 1.
Figure 3:
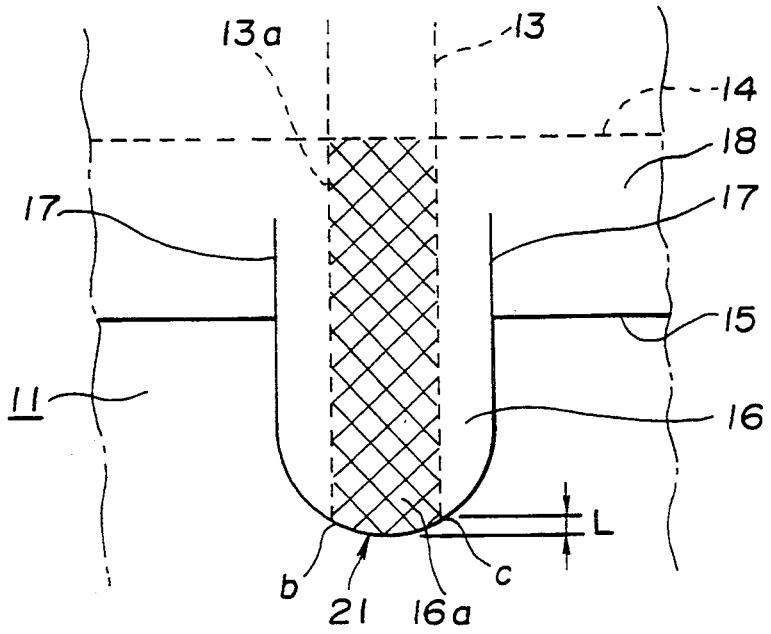
FIG. 3 is a plan view showing a center sealing portion of a packaging film for a packaged article according to the present invention.
Figure 4:
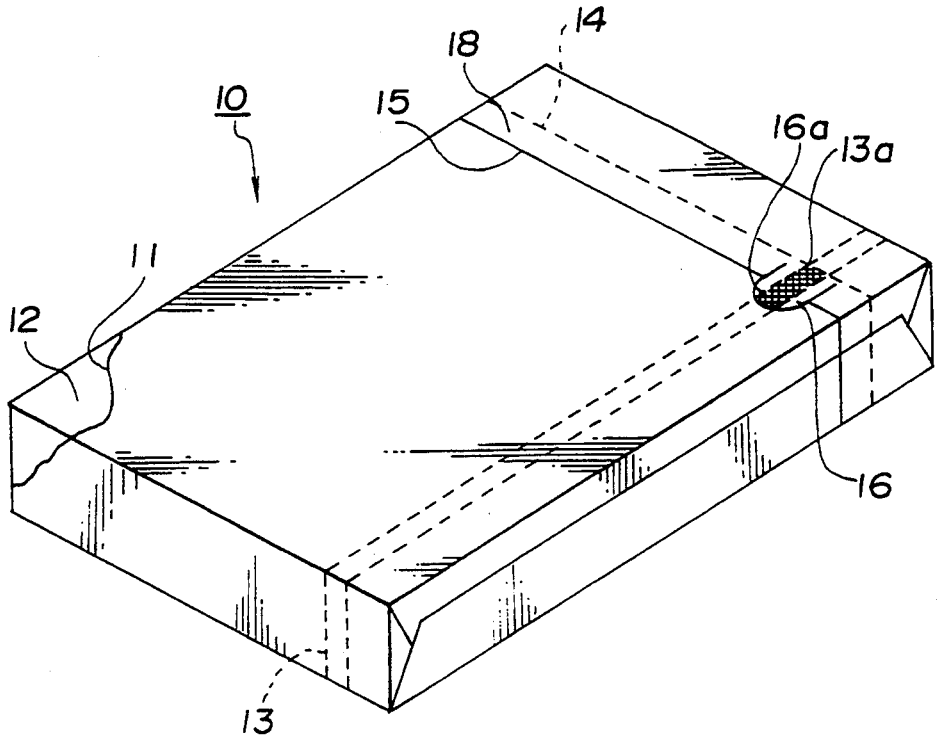
FIG. 4 is a perspective view showing a packaged article obtained by packaging an article with a packaging film, with a portion of the film being broken away.

FIGS. 3 and 4 illustrate a packaged article 10 obtained by packaging and enclosing a rectangular box-shaped article 12, such as a tape cassette, with a wrapping film 11. Similarly to the film employed for packaging the article shown in FIGS. 1 and 2, the packaging film 11 employed in the packaged article 10 is formed of a transparent bi-axially stretched polypropylene film (OPP) having a thickness on the order of 25 to 30 μm. A severing tape 13 for tearing the packaging film 11 when taking out the article 12 is connected to the inner surface of the packaging film 11.

The packaging film 11 is cut to an outer dimension slightly larger than the developed size of the article 12 and a tearing tab 16 in the form of a strip is protuberantly formed at a longitudinal end 15, more precisely, at a wrapping terminal longitudinal end of the packaging film 11. The proximal end of the tearing tab 16 is formed with slits 17, 17 as extensions of both side edges of the tab 16 into the main portion of the packaging film, as shown in FIG. 4. The tearing tab 16 has its distal end **16*a*** formed arcuately, for example, semi-circularly, for substantially diminishing the dimension along its width.

The packaging film 11 is wrapped around the entire outer periphery of the article 12 so that its both longitudinal ends 14, 15 along the wrapping direction making up a center sealing region 18 are overlapped with each other and so that its outer lateral sides are folded on the outer lateral surfaces of the article 12. The center sealing region 18 and the folded outer lateral sides of the packaging film 11 are heat-fused for tightly wrapping and sealing the article 12. The film and the article are then heat-treated in their entirety by a heat-shrinking unit, not shown, for heat-shrinking the film 11 for removing wrinkles and creases on the surface of the packaged article and tightly applying the film 11 onto the outer periphery of the article 12 for completing the packaged article 10.

Figure 5:
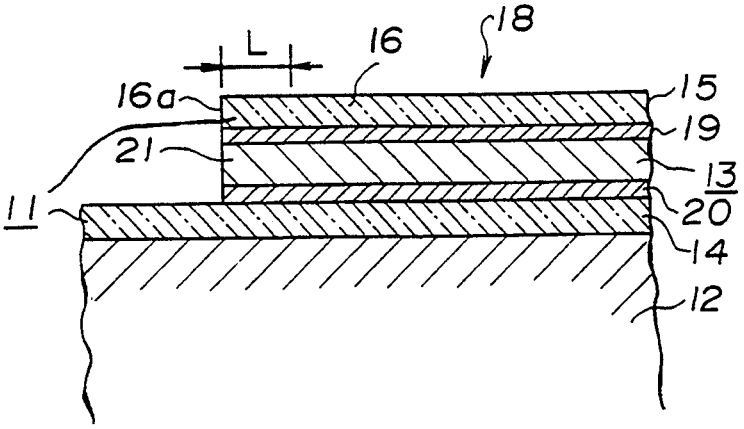
FIG. 5 is a cross-sectional view showing essential portions of a center sealing portion of the packaging film for the packaged article prior to heat-treatment.

The severing tape 13 has an adhesive layer 19 on its one surface so as to be bonded to the inner surface of the packaging film 11 beginning from the distal end of the tab 16 protuberantly formed at the wrapping terminal end 15 of the packaging film 11 for extending along the entire length of the film 11 along the article wrapping direction, as shown in FIG. 5. The severing tape 13 is formed of a material having a heat shrinkage percentage lower than that of the packaging film 11. Besides, the severing tape 13 is formed of a material having a thickness on the order of 70 μm which is larger than the thickness of the packaging film 11 which is on the order of 25 to 30 μm for increasing its tensile strength. Meanwhile, in the present embodiment, the heat shrinkage percentage of the packaging film and that of the severing tape 13 are 4 to 6% and on the order of 1%, respectively.

The dimension of the severing tape 13 along its width is set to about one-half of the dimension of the tearing tab 16 along its width so that the severing tape 13 is not moved off the tearing tab 16 even though the packaging film 11 is deviated along the width of the package 12 during wrapping the packaging film 11 around the article 12. Meanwhile, the dimensions of the severing tape 13 and the tearing tab 16 along the widths of the packaged article are selected to be 2 mm and 4 mm, respectively.

Figure 6:
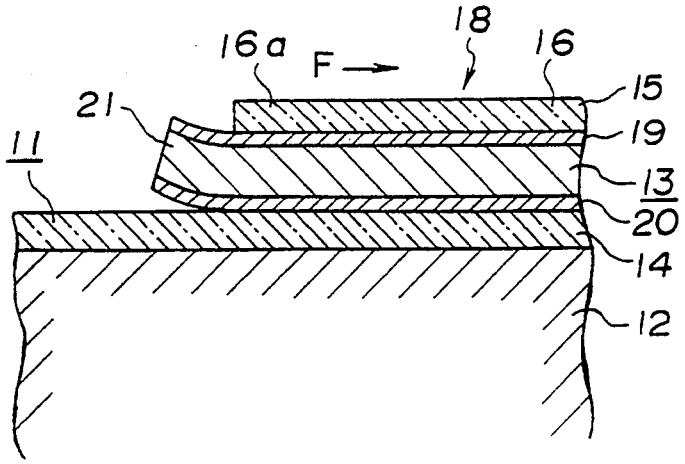
FIG. 6 is a cross-sectional view for illustrating the protruding exposure of the foremost part of the tearing tape at the center sealing portion of the packaging film.

Meanwhile, a longitudinal end 13*a* of the severing tape 13 which is in register with the center sealing region 18 of the packaging film 11 at which the longitudinal ends of the film 11 are overlapped when wrapping the film 11 around the article 12 is provided with a printing layer 20, such as by gravure printing, as shown in FIGS. 5 and 6. Consequently, when the center sealing region 18 of the packaging film 11 is heat-fused for bonding the longitudinal end 15 of the film 11 on its other longitudinal end 14, the longitudinal end 13*a* of the severing tape 13 provided with the printing layer 20 is not bonded to the opposite longitudinal end 14 of the packaging film 11. In other words, the printing layer 20 plays the part of a non-fusing portion.

Meanwhile, since the distal end 16*a* of the tearing tab 16 is semi-circular in contour, an arcuate region bc of the distal part 16*a* facing the distal end of the severing tape 13 provided with the printing layer 20 (FIG. 3) represents a non-fusing region 21 which is not bonded to the longitudinal end 14 of the packaging film 11 constituting the center sealing region 18 of the packaging film 11 at the time of heat fusion of the center sealing region 18. The non-fusing region 21 preferably has a distance L along the wrapping direction which is not less than 0.2 mm. In the present embodiment, the distance is set to about 0.27 mm.

The distal end of the severing tape 13 is protruded and exposed from the distal end 16*a* of the tearing tab 16 on heat shrinking the packaging film 11 in its entirety by the heat shrinking unit, not shown. That is, while the tearing tab 16 is bonded to the longitudinal end 14 of the center sealing region 18 by the heat shrinkage for the center sealing region 18, the force of heat fusion is diminished by the reduced size of the semi-circular distal end 16*a* along its width.

The tearing tab 16 is heat-shrunk as a result of the heating operation on the packaging film 11 by the heat shrinkage unit. The severing tape 13 is also heat-shrunk simultaneously. However, the severing tape 13 is shrunk to a lesser extent than the tearing tape 16 because the severing tape 13 is formed of a material having a smaller heat shrinkage percentage than that of the packaging film 11. Consequently, as the distal end 16*a* of the tearing tab 16 exhibiting a lower force of heat fusion is heat-shrunk along the direction shown by an arrow F in FIG. 6, the portion of the non-fusing region 21 which becomes exposed at the distal end of the severing tape 13 increases gradually in size. As a result, the non-fusing region 21 of the severing tape 13 is protruded and exposed significantly from the distal end 16*a* of the tearing tab 16.

Figure 7:
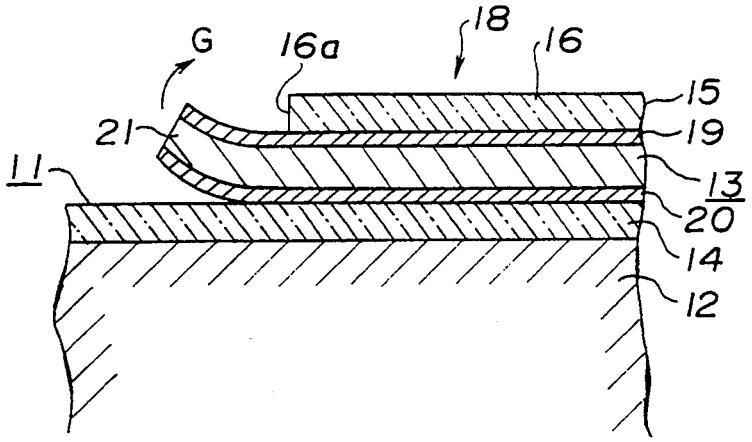
FIG. 7 is a cross-sectional view showing essential portions of the center sealing portion of the packaging film for the packaged article subsequent to heat-treatment.

As the packaging film 11 is heat-treated further, the tearing tab 16 is progressively heat-shrunk as it pulls the severing tape 13 along the direction of arrow F in FIG. 6, until the non-fusing region 21 of the severing tape 13 protruded and exposed from the distal end 16*a* of the tearing tab 16 is curled up as shown by arrow G in FIG. 7. In the present embodiment, the curled portion of the non-fusing region 21 is selected to be on the order of 0.5 mm both in length and height.

By manually pulling the non-fusing region 21 of the severing tape 13 protruded and curled from the distal end 16*a* of the tearing tab 16, the packaging film 11 wrapped around the article 12 is torn of along with the tearing tab 16. There is no necessity of scratching the tearing tab 16 with the finger nail to pick up the distal end of the severing tape 13, while there is no risk of the severing tape 11 being torn halfway without rendering it possible to remove the packaging film.

Figure 8:
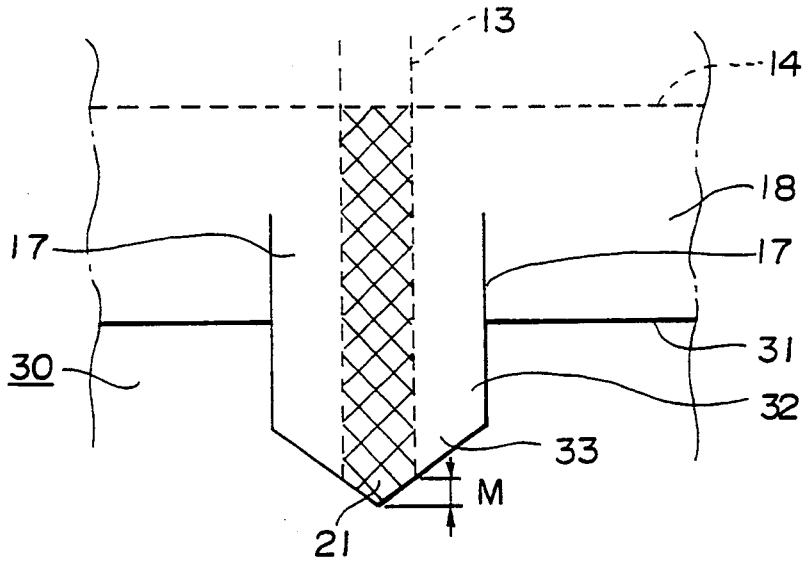
FIG. 8 is a plan view showing a center sealing portion of a packaging film for a packaged article according to a modification of the present invention.

FIG. 8 shows a modification of a packaged article employing a packaging film according to the present invention. Parts and components which are the same as those of the first embodiment are depicted by the same reference numerals and the corresponding description is omitted for clarity. The packaging film 30 employed in the second embodiment has its wrapping terminal end 31 formed with a protruded tearing tab 32 which is in the form of a strip in its entirety and which has its distal end 33 bias-cut from a center portion towards its proximal end. Consequently, the non-fusing region 21 at the distal end of the severing tape 13 has an increased distance M so that the non-fusing region 21 can be protruded and exposed to a larger extent than with the packaging film of the first embodiment by the heat-treatment of the packaging film 30.

Figure 9:
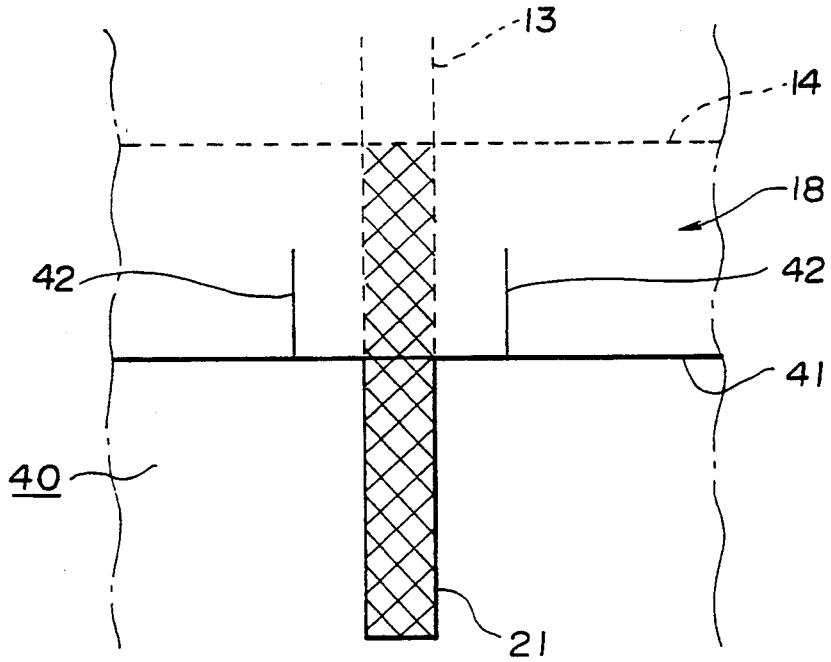
FIG. 9 is a plan view showing a center sealing portion of a packaging film for a packaged article according to a further modification of the present invention.

FIG. 9 shows another modification of a packaged article employing a packaging film according to the present invention. It is noted that parts and components which are the same as those of the first and second embodiments are depicted by the same reference numerals and the corresponding description is omitted for clarity. The packaging film 30 employed in the present third embodiment has its wrapping terminal end 41 formed with a pair of slits 42, 42 as tearing guides between which the severing tape 13 is secured to the inner surface of the wrapping terminal end 41 of the packaging film 40. The distal end of the severing tape 13 is directly protruded from the wrapping terminal end 41 of the packaging film 40. In this manner, the non-fusing region 21 at the distal end of the severing tape 13 is protruded and exposed more pronouncedly than with the previous embodiments.

What is claimed is:

1. A package comprising a film wrapped around an article to be packaged and having its wrapping beginning and terminal ends heat-fused to each other for enclosing said article, said package further comprising a tab protuberantly formed at the wrapping terminal end of said film as an aid for tearing said film after said film has been wrapped around said article, and a severing tape bonded to said film from the distal end of said tab throughout the entire length of said film along the film wrapping direction, said severing tape being narrower in width than said tab and being formed of a material having a heat shrinkage percentage lower than that of said film, said tab being bonded to said film when said film is heat-fused, said tab having its distal end part of a size along the width thereof less than its proximal end part to form a fusing region of a limited area dimension.

2. The package as claimed in claim 1 wherein said tab has the fusing region having an arcuate distal end.

3. The package as claimed in claim 1 wherein said severing tape has a non-bonded portion at a zone thereof substantially in register with the wrapping terminal end of said film which acts as a heat fusing region by being superposed on said wrapping beginning end of said film when said film is wrapped around said article.

4. The package as claimed in claim 3 wherein said non-bonded portion of said severing tape has a curled part which is curled up from the plane of said film by heat fusion of said wrapping beginning and terminal ends of said film.

5. The package as claimed in claim 3 wherein said non-bonded portion comprises a printing layer formed on the surface of said severing tape facing said film.

6. A package comprising a film wrapped around an article to be packaged and having its both longitudinal ends heat-fused to each other for packaging said article, and a severing tape bonded to the inner surface of said film in contact with said article, said severing tape being bonded to said film throughout the entire length of said film along the article wrapping direction, said film having a tab formed by a pair of slits in the wrapping terminal end of said film at a distance from each other larger than the width of said severing tape, said slits acting as a guide for tearing off said film, said severing tape being lesser in width than said tab and being formed of material having a heat shrinkage percentage lower than that of said film, said severing tape having its distal end protruded from the transverse edge of the wrapping terminal end of said film.

7. The package as claimed in claim 6 wherein said severing tape has its distal end curled up by heat fusion of both longitudinal ends of said film.

8. The package as claimed in claim 6 wherein said severing tape is exposed from said film by not less than 0.2 mm.

9. A method for wrapping an article with a film by wrapping said film around said article and heat fusing both longitudinal ends of said film, comprising the steps of bonding a severing tape to the inner surface of said film in contact with said article throughout the entire length of said film along the article wrapping direction, said severing tape being formed of a material having a heat shrinkage percentage lower than that of said film, forming a pair of slits at a wrapping terminal end of said film at a distance from each other larger than the width of said severing tape for defining a tab, said slits acting as a guide when tearing off said film, heat-fusing the longitudinal ends of said film which are superposed one on the other, with the article being wrapped and enclosed by said film, and heat-shrinking said film in its entirety for exposing the distal end of said severing tape from the distal end of said tab.

10. The method as claimed in claim 9 further comprising the step of forming a non-bonded region at least at a portion of said severing tape substantially in register with a heat-fused region of said film.

11. The method as claimed in claim 9 further comprising the step of curling the distal end of said severing tape exposed from the distal end of said tab upwards with respect to said film.

* * * * *